US005909606A

United States Patent [19]

Fujiwara

[11] Patent Number: 5,909,606

[45] **Date of Patent: *Jun. 1, 1999**

[54] TEARABLE SEALING MEMBER, DEVELOPING APPARATUS AND PROCESS CARTRIDGE

[75] Inventor: Yasuo Fujiwara, Urawa, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,745

[22] Filed: Jan. 7, 1997

Related U.S. Application Data

[63] Continuation of application No. 08/286,332, Aug. 5, 1994, abandoned.

[30] Foreign Application Priority Data

Aug. 10, 1993 [JP] Japan ..... 5-216933

[51] Int. Cl.[6] ..... G03G 15/08

[52] U.S. Cl. ..... 399/106

[58] Field of Search ..... 399/103, 105, 399/106, 262; 222/DIG. 1, 541.4, 541.9; 206/532; 156/308.4; 428/419, 910

[56] References Cited

U.S. PATENT DOCUMENTS

| | | | |
|---|---|---|---|
| 4,062,385 | 12/1977 | Katusha et al. | 222/DIG. 1 |
| 4,895,104 | 1/1990 | Yoshino et al. | 399/106 |
| 4,931,838 | 6/1990 | Ban et al. | 355/260 |
| 5,080,745 | 1/1992 | Paull | 222/DIG. 1 X |
| 5,177,540 | 1/1993 | Honda et al. | 399/106 |
| 5,206,619 | 4/1993 | Kita | 399/111 |
| 5,258,814 | 11/1993 | Davies | 355/260 |
| 5,335,831 | 8/1994 | Foster | 222/DIG. 1 X |
| 5,370,761 | 12/1994 | Chitouras | 222/DIG. 1 X |
| 5,434,654 | 7/1995 | Nagai | 355/260 |
| 5,585,895 | 12/1996 | Yashiro et al. . | |

FOREIGN PATENT DOCUMENTS 89-13531 8/1989 Rep. of Korea .

*Primary Examiner*—Robert Beatty

*Attorney, Agent, or Firm*—Fitzpatrick, Cella, Harper & Scinto

[57] ABSTRACT

A tearable sealing member for unsealably sealing an opening of a developer container for containing a developer for an image forming apparatus includes a seal film for closing the opening, a flexible tape extending along a surface of the seal film, wherein the seal film is an uniaxially orientated foamed resin material and has an average density of not less than 0.65 g/cc and not more than 0.9 g/cc, measured under JIS K6758, and wherein the seal has a heat contraction rate in the orientated direction of not less than 10% and not more than 10%.

41 Claims, 7 Drawing Sheets

TEARABLE SEALING MEMBER, DEVELOPING APPARATUS AND PROCESS CARTRIDGE

This application is a continuation of application Ser. No. 08/286,332, filed Aug. 5, 1994, now abandoned.

FIELD OF THE INVENTION AND RELATED ART

The present invention relates to a tearable sealing member, a developing apparatus and a process cartridge.

There are known various image forming machines of electrophotographic type such as small machines, including a printer for information apparatuses such as computer, CAD or the like, or facsimile machine, and a large size machine such as an electrostatic copying machine or the like for office use. In either of them, a developer is accommodated through one method or another, and the image forming operation is carried out using the developer.

In an example of such a printer, it is usable with a detachably mountable process cartridge. Once the process cartridge is mounted, the developer is supplied to a developing sleeve and then to a photosensitive drum gradually by operating a developer stirring device from a developer container in the cartridge, until the developer contained therein is used up.

As regards a developer container for a copying machine or the like, there are a replenishing type container and a stationary container. In the former type, the developer container is built in the main assembly of the copying machine, and the container is filled with at once by the total capacity of the container, and in the latter, the developer container is mounted in the main assembly of the copying machine, and it is maintained stationary therein in which the developer is gradually supplied to the developing device by operating the developer stirring means as in the process cartridge, until the developer is used up.

In any case, in order to prevent leakage of the developer during transportation or during non-use period, the opening for the supply of the developer is provided with a sealing member. In the case of the process cartridge or the stationary type container, a peeling member is used.

In this case, a sealing member in the form of a film or tape is bonded to cover the opening of the cartridge or the stationary type container. When the developer is to be supplied into the main assembly, the sealing member is pulled out externally to open the developer container, thus permitting the developer accommodated in the container to flow into the main assembly through the opening.

The peeling member includes an easy peel film type and a tearable sealing member type comprised of a cover film and a tear tape as disclosed in U.S. Pat. No. 4,931,838. The tearable type is advantageous in the following respects:

(1) The force required for the opening is small, and therefore, the operativity is good.

(2) The covering film is maintained adhered to the container, and it is not removed during the developer replenishment. Therefore, the cover film can be strongly bonded to the container, thus permitting assured prevention of the developer leakage.

(3) It can be avoided that small pieces of the bonding material coagulated and broken are introduced into the developer upon the opening.

(4) The supply of the developer to the developing device from the container can be controlled or adjusted by properly changing the width of the tear tape.

In order to use these advantages, the material of the cover film and the tear tape are preferably selected. Conventionally, the following materials are considered to be used.

As for the covering film, consideration has been made to the use as the base material uniaxial oriented polyethylene film, uniaxial polypropylene film, uniaxial foamed polypropylene film (e.g., Sunypearl SPMC, available from Mitsui Toatsu Platec Kabushiki Kaisha, Japan), which is oriented in the opening direction in consideration of the easy tearing. As the tear tape, the consideration is made to use as the base material biaxial oriented polyester film (for example, "Tear Tape", available from Fujimori Kogyo, Japan) or the like. The present invention is intended to provide further improvements.

SUMMARY OF THE INVENTION

Accordingly, it is a principal object of the present invention to provide a tearable sealing member, a developer container using the tearable sealing member, and a process cartridge in which the stability of the tearing is accomplished.

It is another object of the present invention to provide a tearable sealing member, a developer container using the tearable sealing member, and a process cartridge, wherein leakage of the developer can be prevented even upon impact due to falling or the like.

It is a further object of the present invention to provide a tearable sealing member, a developer container using the tearable sealing member, and a process cartridge, wherein curling of the member is reduced.

It is a further object of the present invention to provide a tearable sealing member, a developer container using the tearable sealing member, and a process cartridge, the strength of the member is sufficient.

According to an aspect of the present invention, there is provided a tearable sealing member, a developer container using the tearable sealing member, and a process cartridge, wherein an average density of a base member of the cover film is not less than 0.65 g/cc, and the covering film base member is in the form of a complete film to avoid occurrence of fuzz from the cover film is avoided upon the opening, thus stabilizing the longitudinal tearing stability. For the purposes of this specification, "fuzz" refers to a torn portion of the covering film base member that becomes fuzzy or fluffy.

According to another aspect of the present invention, there is provided a tearable sealing member, a developer container using the tearable sealing member and a process cartridge, in which a rupture strength of the base member of the cover film is not less than 1 kg/mm in the non-oriented direction so that the cover film is not easily broken in the non-oriented direction even upon impact to the developer container as in the case of falling thereof or the like.

According to a further aspect of the present invention, there is provided a tearable sealing member, a developer container using the tearable sealing member and a process cartridge in which a heat contraction rate of the base member of the cover film is limited in a predetermined range so that it can be avoided that the cover film is curled in a significant extent upon the heat fusing between the cover film and the tear tape (unification), and therefore, the cover film/tear tape units can not be corrected fused on the member defining the opening.

According to a yet further aspect of the present invention, there is provided a tearable sealing member, a developer container using the tearable sealing member and a process cartridge in which an average density and the strength in the non-oriented direction and heat contraction rate of the base member of the cover film is controlled so that the stable tearing, durability against pressure and less heat curling property, are improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

General Arrangement of a Tearable Sealing Member

Figure 1:
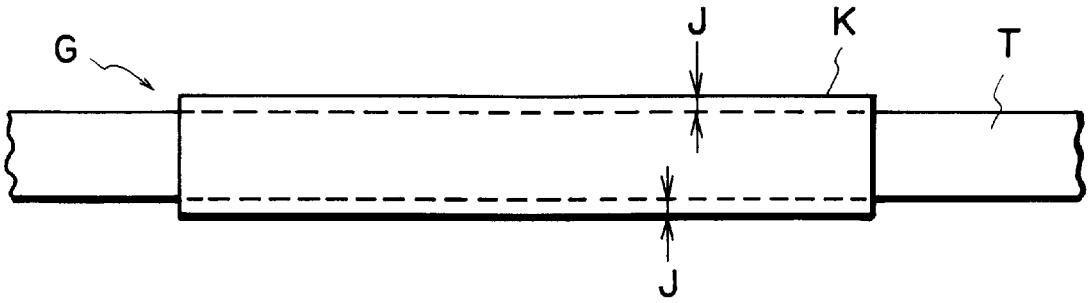
FIG. 1 is a top plan view of a tearable sealing member according to a first embodiment of the present invention.

As shown in FIG. 1, a tearable sealing member G according to an embodiment of the present invention is in the form of a unified cover film K and a tear tape T having a width smaller than that of the cover film K. In order to permit assured sealing, the cover film K is provided with sealing portions J larger than the sealing width by 1–2 mm approx. at the opposite sides.

Figure 2:
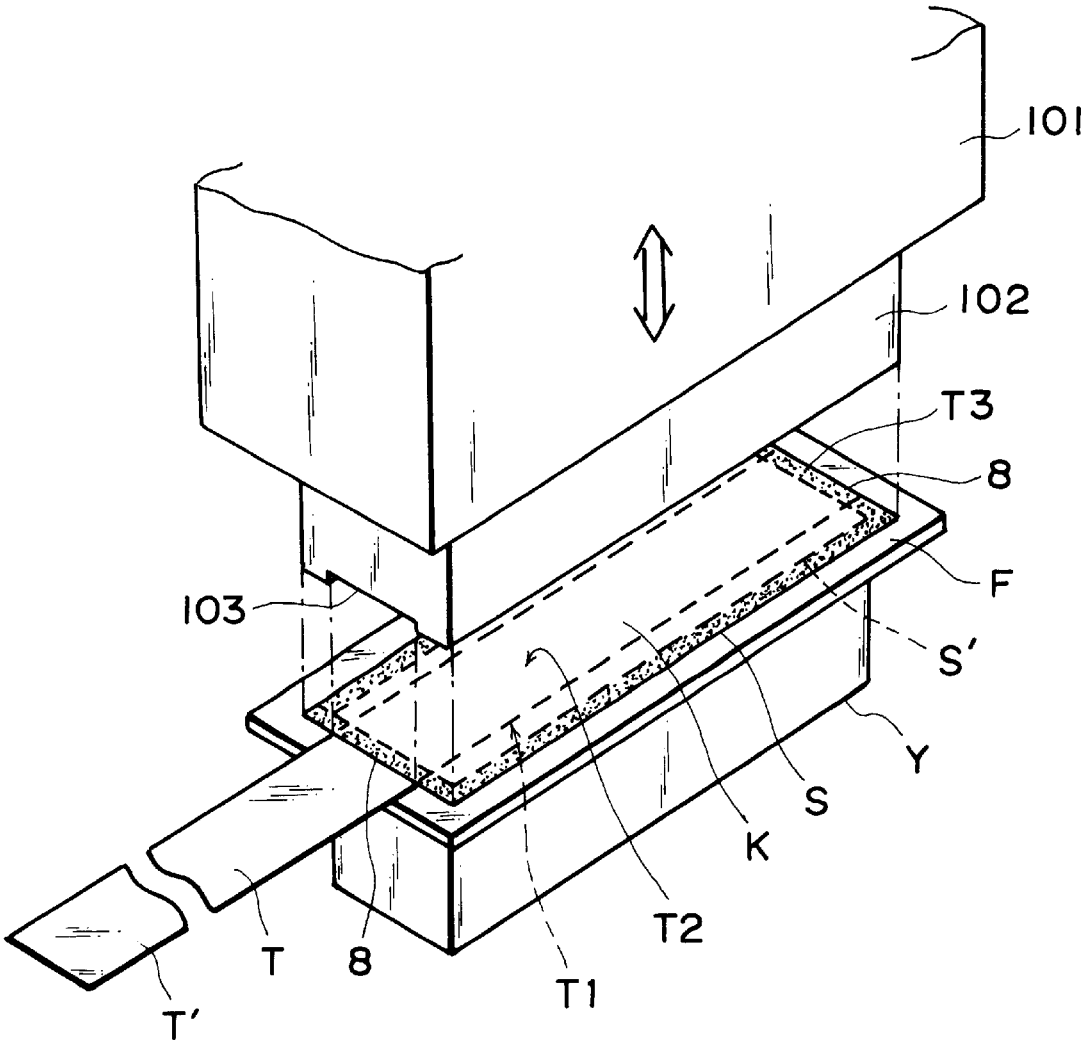
FIG. 2 illustrates a method in which a tearable sealing member is adhered to a developer container.

FIG. 2 shows a method of sealing of the tearable sealing member G onto a sealing surface S of a flange F adjacent an opening of a developer container Y. When the sealing is effected by thermo compression bonding, a seal bar 102 of a horn 101 is pressed at approx. 110° C.–130° C. with 1.5 kgf/cm$^2$–5 kg/cm$^2$ for 1–3 sec. The portion of the short sides of the sealing surface 8 overlapped with the tear tape T is subjected to the thermo-compression bonding more than the other part by the thickness of the tear tape T, and therefore, the steps 103 are provided at the short sides of the seal bar 102, corresponding to the thickness of the tear tape.

Upon the sealing operation, the parallelism is maintained between the container Y and the seal bar 102 to permit uniform thermo-compression bonding. If this not enough, additional stress is applied to the sealing surface S of the unit G with the result that the film is torn by falling and impact by an inside edge S' of the sealing surface with the result of the liability of the toner leakage.

Cover Film

Figure 3:
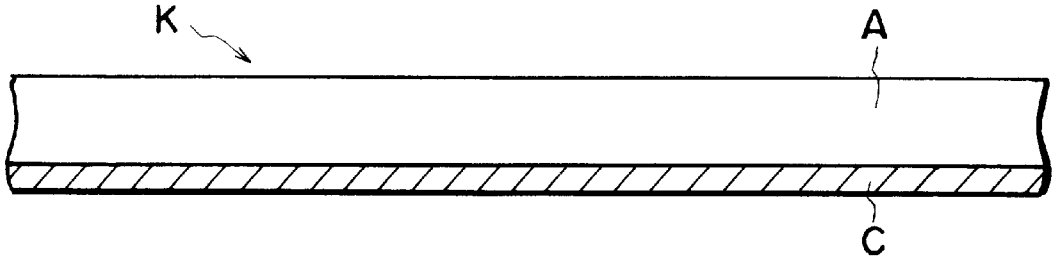
FIG. 3 is a sectional view of a cover film according to an embodiment of the present invention.

Referring to FIG. 3, the description will be made as to the cover film K in this embodiment. As shown in FIG. 3, the cover film K comprises a base material A and a sealant layer C.

[Material of the Base Member A]

The material of the base member A may be a uniaxial oriented film or seat which has sufficient sealing property for the opening of the container and which is easily torn in one direction. Examples of the material include uniaxial oriented polyethylene film, uniaxial oriented polypropylene film, oriented and foamed polypropylene film and the like.

[Strength of the Base Member A]

Figure 4:
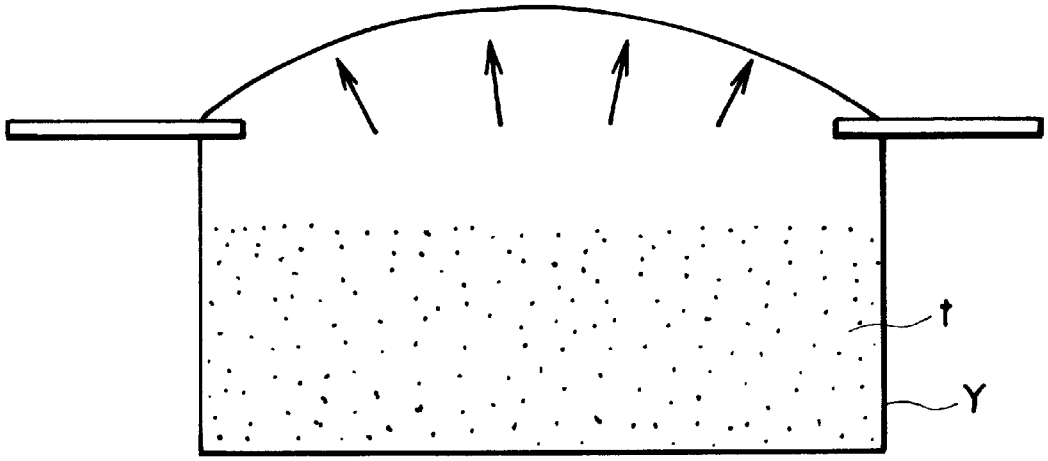
FIG. 4 is a sectional view when an internal pressure is applied to the tearable sealing member.
Figure 5:
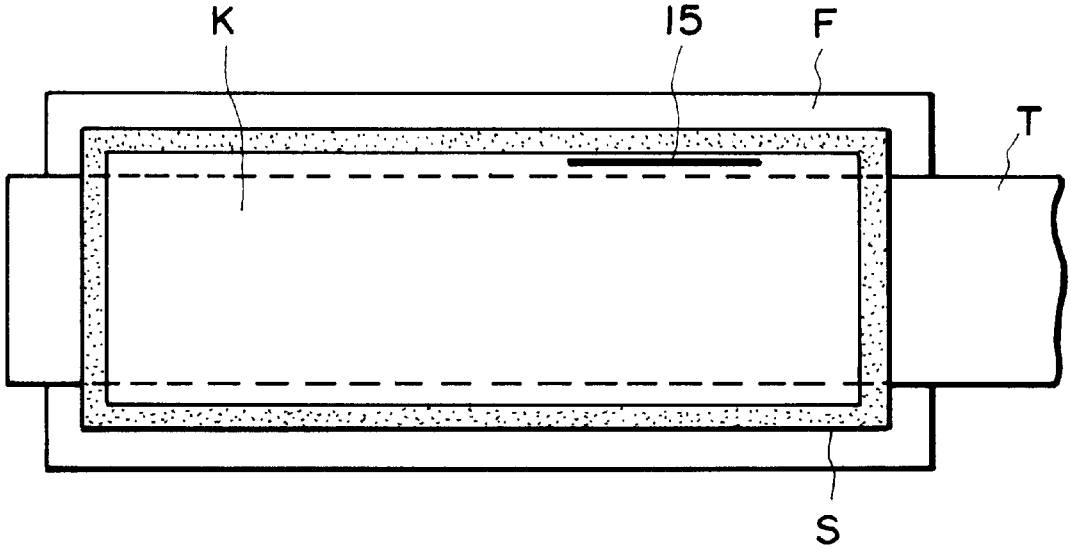
FIG. 5 illustrates a crack of a cover film base member.

When the process cartridge is delivered into the market after the tearable sealing member G is adhered to the container, as shown in FIG. 4, the process cartridge may be subjected to falling, other impacts or pressure or the like during transportation thereof. If the process cartridge is subjected to significant load, the seal may be broken at a edge portion 15 where the stress may remain in the cover film base member A at the inside edge of the seal bar 102 as shown in FIG. 5, with the result of liability of the developer leakage.

Since the covering film base member A is uniaxially oriented in such a direction that the direction of the stress due to the edge of the seal is the same as the longitudinal tearing direction, and therefore, it is easily torn in the non-oriented direction.

In order to solve the problem, the strength of the cover film base member A is to be considered. As a result of experiments of the inventor, it has been found that the rupture strength of the base member A of the cover film is preferably not less than 1.5 kg/mm and not more than 3 kg/mm in the non-oriented direction, and further preferably not less than 1.3 kg/mm and not more than 3 kg/mm. The rupture strength has been measured under JIS K1702 with 10 mm in width.

[Film Thickness of the Base Member A]

Recently, a developer container having a wide opening such as 50 mm or the like, has been developed. With the increase of the opening area, the sealing film is subjected to large load upon impact or the like. In view of this, the film thickness of the cover film base member A is preferably not less than 130 $\mu$m and not more than 150 $\mu$m.

Use of the cover film base member A of the above-described thickness is effective against developer leakage when the opening width of the developer container is not less than 30 cm, and particularly, it is effective when the opening width is 50 mm or larger.

Figure 6:
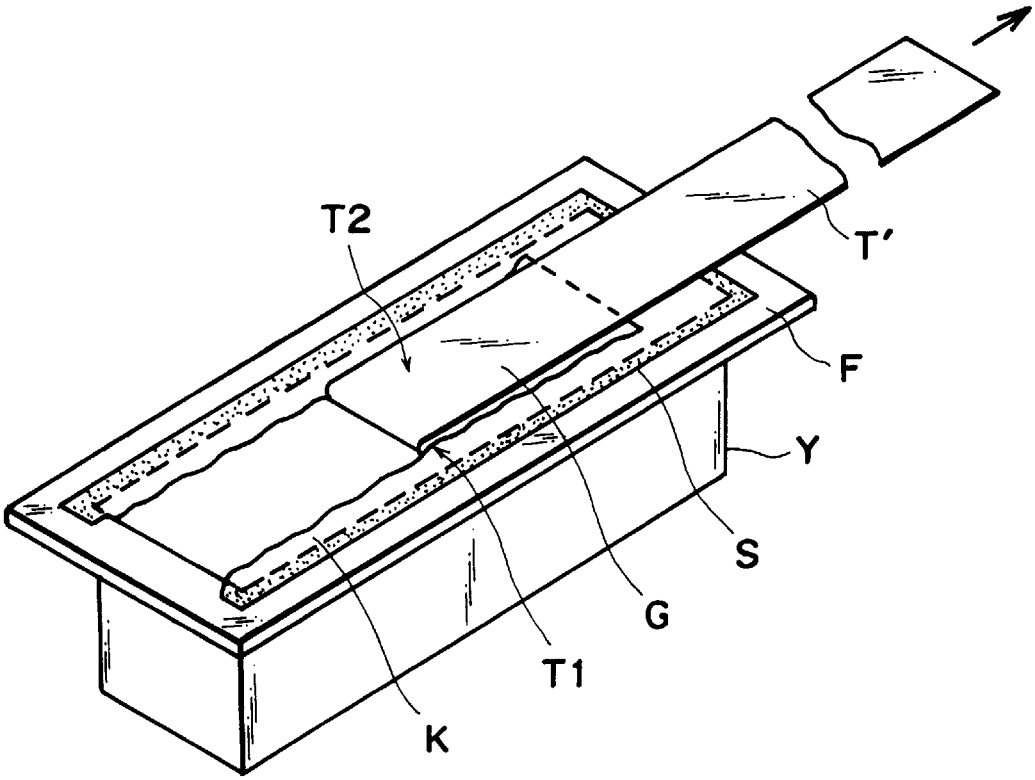
FIG. 6 illustrates an example of a opening method of the tearable sealing member.

As shown in FIG. 6, an operator pulls an end T' of the folded-back tear tape T to tear the cover film K, thus permitting supply of the toner into the developing device from the container Y. In order to avoid occurrence of fuzz of the cover film to permit stable longitudinal tearing, the cover film base member A is preferably oriented foamed polypropylene film or the like having a thickness of not less than 120 μm and not more than 140 μm, with stability of longitudinal tearing.

[Average Density of the Base Member A]

With the oriented foamed polypropylene film, the average density, namely, a reciprocal of the expansion ratio is preferably not less than 0.6 g/cc and not more than 0.9 g/cc, further preferably not less than 0.65 g/cc and not more than 0.8 g/cc. The measurements of the average density were carried out under JIS K6758.

Figure 7:
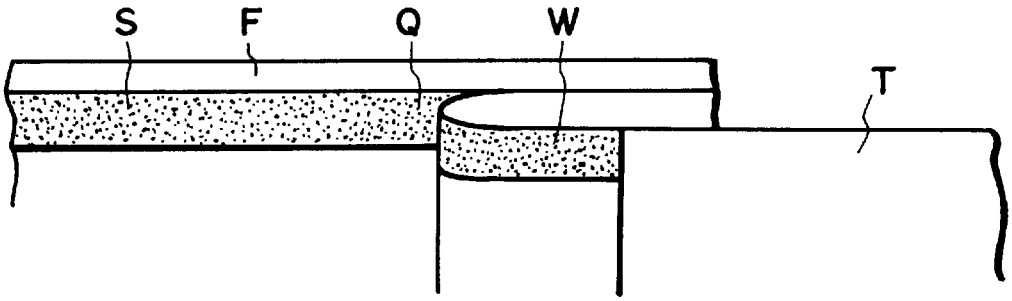
FIG. 7 illustrates coagulation and break (cohesive failure) of the cover film.

If the average density of the cover film base member A is less than 0.6 g/cc, the cover film base member may be coagulated and broken (cohesive failure) as indicated by Q during the opening, as shown in FIG. 7, which may also form fuzz W on the tear tape.

[Thermo-Compression Ratio of the Base Member A]

Figure 8:
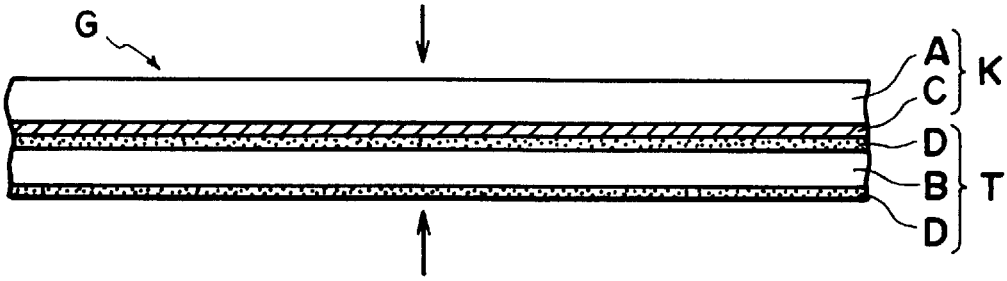
FIG. 8 is a sectional view of a tearable sealing member according to an embodiment of the present invention.
Figure 9:
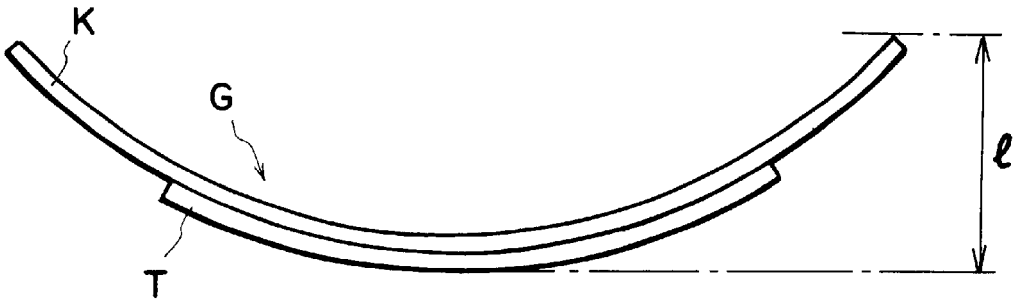
FIG. 9 illustrates an amount of curling of the tearable sealing member.
Figure 10:
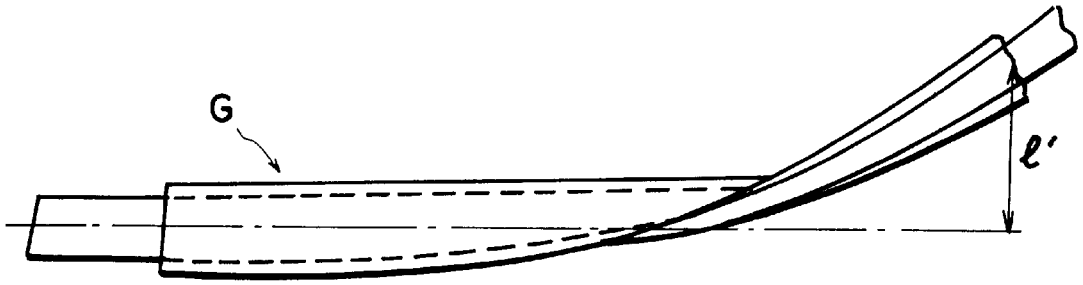
FIG. 10 illustrates an amount of curling of a tearable sealing member.

As shown in FIG. 8, the cover film K is unified with a tear tape T which will be described hereinafter, so as to constitute a tearable sealing member. Depending on the heat contraction rate of the base member A of the cover film K, the tearable sealing member G may curl as shown in FIGS. 9 and 10, upon thermo-compression bonding for the unification. When the curling occurs, the sealing member G is unable to correctly seal the opening of the container. As shown in FIGS. 2 and 6, the tearable sealing member comprises a first portion T1 where the tear tape T extends along one side surface of the cover film K and a second portion T2 at the opposite side surface of the cover film K where an end T3 of the first portion T1 is folded back. When the operator pulls the second portion T2 of the tear tape, the cover film K is torn along the lateral edges of the second portion T2.

As a result of experiments and investigations of the inventor, the curling is not a problem if the heat contraction rate of the cover film base member A is not less than 1% and not more than 10% in the oriented direction, and not less than 0.1% and not more than 3% in the non-oriented direction.

For the measurement of the heat contraction ratio, the tearable sealing member is placed in a gear type hot air oven at 120° C. and for 15 min., and thereafter, the heat contraction rate is measured.

[Material and Thickness of Sealant Layer C]

The sealant layer C is a polyethylene sealant so as to permit to be fused on and unified with a sealant layer D of the tear tape T by heat seal (thermocompression boding). This is not limiting, heat sealing using vinyl acetate resin or ionomer resin, and additionally, impulse sealing or high frequency welder is usable if the material is properly selected by one skilled in the art.

When the made is used with a polyethylene sealant containing several to several tens percent of ethylene-vinyl acetate copolymer as the sealant layer C, the thickness thereof is preferably 10–30 μm in consideration of the bonding strength or the like, further preferably, not less than 15 μm and not more than 25 μm.

Tear Tape

Figure 11:
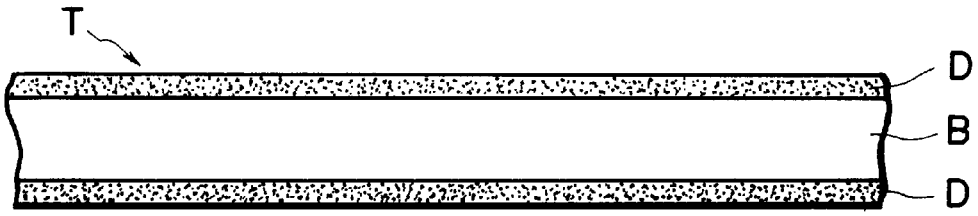
FIG. 11 is a sectional view of a tear tape according to an embodiment of the present invention.

Referring to FIG. 11, the tear tape T constituting the tearable sealing member of this embodiment will be described. The tear tape T comprises a sealant layer D at the front and backsides of the base member B and the base member D, as shown in FIG. 11.

[Base Member B]

The material of the base member B exhibits sufficient strength to permit tearing of the cover film K, more particularly, the tensile strength is not less than three times that of the cover film K.

As for the material thereof, film or sheet members of polyester, polypropylene, polystyrene, nylon or the like resin materials, preferably, biaxial oriented polyester film having a thickness of not less than 20 μm and not more than 40 μm.

[Sealant Layer D]

The sealing layer D is made of the similar material as the sealant layer C of the cover film. The similar material is desirable since then the sealant layers C and D are easily fused and bonded upon the thermocompression fusing for the purpose of unification of the cover film K and the tear tape T.

When the use is made with the polyethylene sealant containing several percent to several tens percent of ethylene-vinyl acetate copolymer as the sealant layer D, the film thickness is preferably 20–40 μm in consideration of the bonding strength or the like, further preferably, not less than 25 μm and not more than 35 μm.

[Nylon Layer N]

Figure 12:
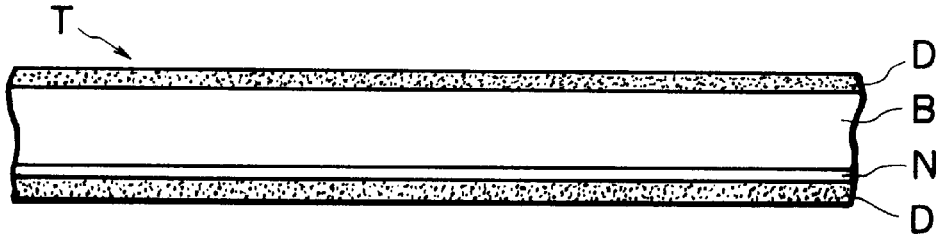
FIG. 12 is a sectional view of a tear tape according to an embodiment of the present invention.

As shown in FIG. 12, the tear tape T may be provided with a nylon layer N which functions as a cushion layer upon the heat sealing between the base member B and the sealant layer D.

The thickness of the nylon layer N is preferably not less than 10 μm and not more than 20 μm, further preferably, not less than 13 μm and not more than 17 μm.

Process Cartridge and Image Forming Apparatus

Figure 13:
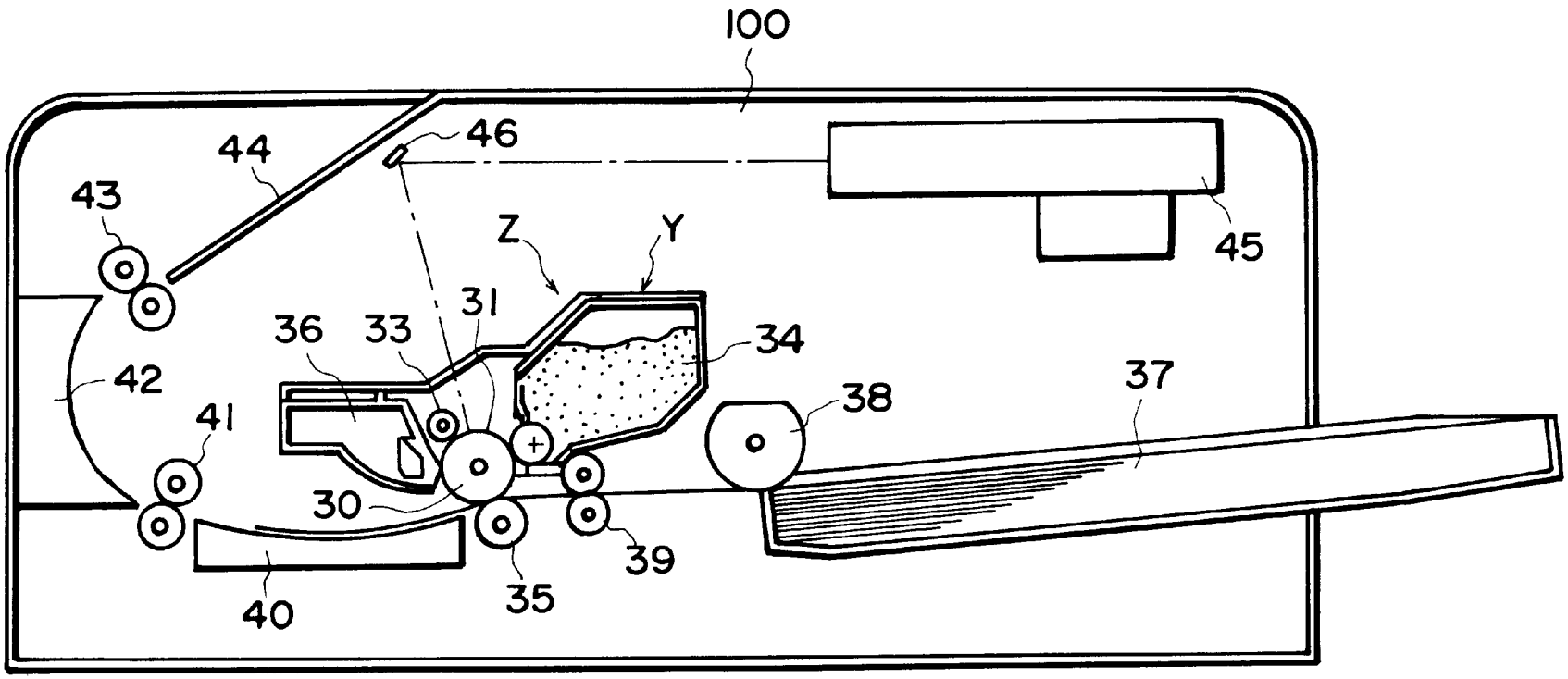
FIG. 13 is a sectional view of a process cartridge, and an image forming apparatus using the process cartridge, which use the tearable sealing member according to an embodiment of the present invention.

As shown in FIG. 13, a process cartridge and an image forming apparatus will be described in which the tearable sealing member G according to the above-described embodiment is used as a sealing member for a process cartridge usable with various printers.

[Image Forming Apparatus]

A video signal from a controller (not shown) is supplied to a laser scanning optical system unit 45, including a semiconductor layer, a collimator lens, a polygonal mirror, an f-θ lens and tilt correction mechanism or the like. The video signal is supplied to the semiconductor laser, and the resultant layer beam is collimated by the collimator lens and is incident on a polygonal mirror which is rotating at a high speed. By doing so, the laser beam is scanningly projected on an exposure portion 31 of a photosensitive drum 30 by way of reflection mirrors 46.

In order to detect a timing for scanning the photosensitive surface of the photosensitive drum 30 by the semiconductor laser, that is, the timing for supplying the video signal, a beam detector (not shown) for detecting the laser beam is placed at a predetermined position before the start of the scanning of the photosensitive surface of the drum 30, and the video signal is supplied in synchronism with the signal from the beam detector.

Around the photosensitive drum 30, there are disposed a charging roller 33, an exposure station 31, a developing device 34, a transfer roller 35 and a cleaner 36. There are contained in a process cartridge with the developer, and it is detachably mountable to the main assembly 100 of the apparatus. A recording material stacked on a cassette 37 is fed out by a feeding roller 38 in response to a signal from an unshown CPU, and is further fed by registration rollers 39 at proper timing in synchronism with the developed image on the photosensitive drum 30. The image is transferred onto the recording material, which is conveyed along a guide 40 to a fixing device where the transferred image is fixed by a fixing roller 41. It is finally discharged to a discharge tray 44 by discharging rollers 43.

[Process Cartridge Z]

The description will be made as to the process cartridge Z.

Figure 14:
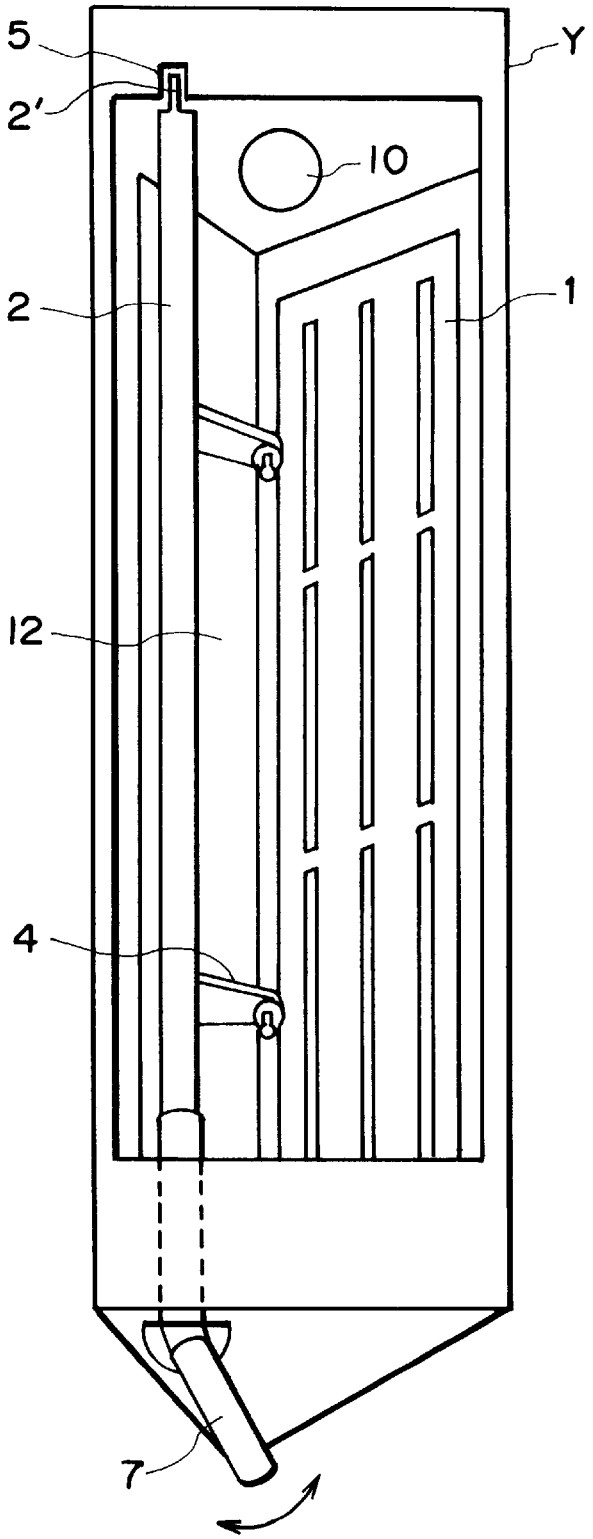
FIG. 14 is a perspective view of a developer container in a process cartridge of FIG. 13.

Referring to FIG. 14, the developer container Y of the cartridge Z comprises a developer stirring means including stirring plates 1, stirring shaft 2 and stirring arm 4, a filling port 10, developer discharging port 12, a stirring shaft rotating means 7, sliding portion 2' of the stirring shaft 2 and bearings 5.

Figure 15:
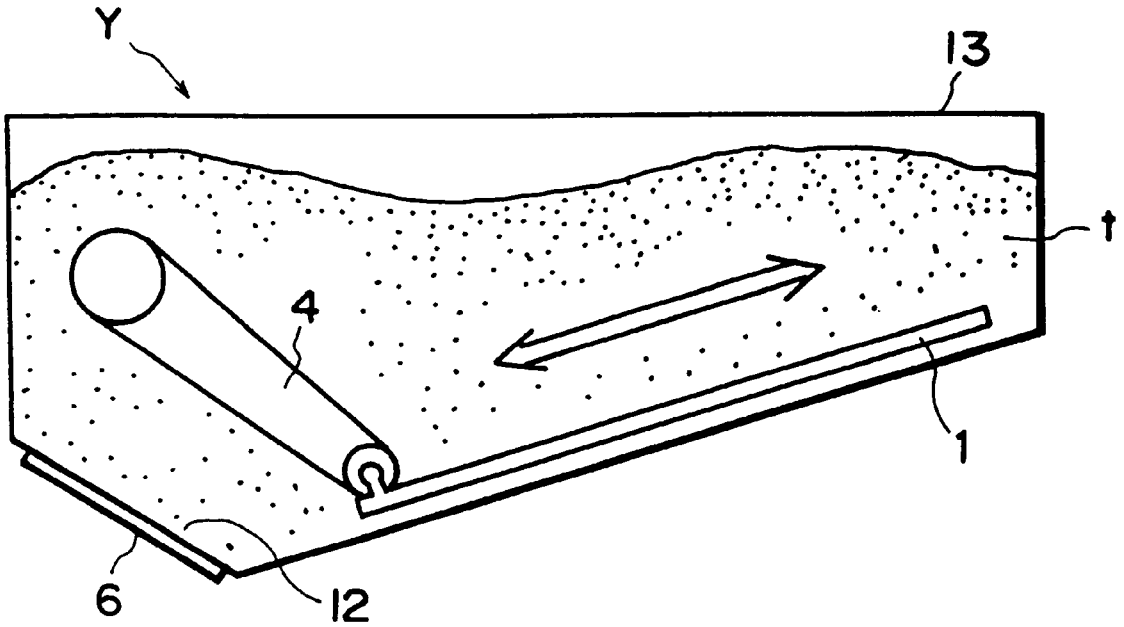
FIG. 15 is a sectional view of a developer container in a process cartridge of FIG. 13.

As shown in FIG. 15, the container Y is hermetically sealed by a cover 13 for sealing after the stirring member is assembled into the developer container Y and a tearable sealing member G for sealing the developer discharging port.

Thereafter, the developer container is unified with a drum container containing the photosensitive drum 30 or the like through ultrasonic wave bonding or the like, into a process cartridge Z. The cartridge Z is mounted to the main assembly 100, and thereafter, the tearable sealing member according to this embodiment is pulled to permit the developer T to be supplied toward the photosensitive drum 30.

Figure 16:
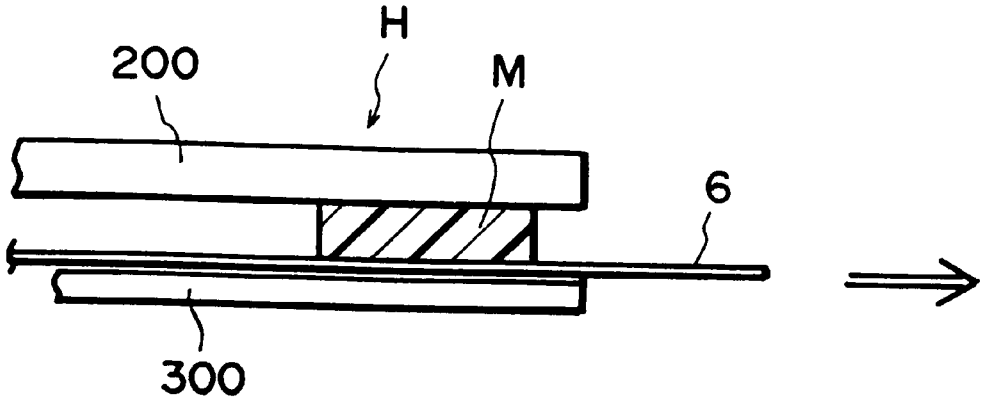
FIG. 16 is a sectional view of a film removing portion in a process cartridge of FIG. 13.

As shown in FIG. 16, at the outlet H of the container Y for the sealing member G, an end seal M of foamed polyurethane material or the like is bonded to the drum container between end portion 200 of the drum container and an end portion 300 of the developer container Y to prevent leakage of the developer upon other opening.

The end seal M is compressed to approx. not less than ½ and not more than ⅓ by the unification with the drum container, from the thickness between 2–5 mm, thus preventing leakage of the developer after the opening.

However, the provision of the end seal M results in increase of the peeling force required for the opening, and in addition, both end portions of the cover film K of the tearable sealing member G are rubbed with the end seal M so that the fuzz occurs.

The causes of the trouble are considered as follows. If the sealing layer C of the cover film K and the sealant layer D of the tear tape T are not completely fused and bonded, the cover film K is torn 2–3 mm wider than the tearing width of the tear tape T in some cases. If this occurs, the fuzz appears.

For this reason, the sealant layer C of the cover film K and the sealant layer D of the tear tape T are the same or similar materials.

<EXPERIMENT EXAMPLES>

The tearable sealing member according to this embodiment is used in the process cartridge Z having the structure described above, and the curling property test, pressure durability test, falling test of the process cartridge, and the tearing stability tests were carried out.

Experiment 1

Four base members A having thicknesses of 120 and 140 μm were prepared as the cover film K, and the same ethylene-vinyl acetate sealant layer C having the thickness of 20 μm was dry-laminated to the respective base members.

As a comparison example, the same member was prepared with which the heat contraction rate of the base member is outside the range described above.

The specifications of the members were as follows.

TABLE 1

| Sample Nos. | | Film thickness (μm) | Heat contraction (%) (oriented direction/ non-oriented direction) |
|---|---|---|---|
| Emb.Ex. | 1 | 120 | 6.0/2.0 |
| | 2 | 140 | 5.0/1.0 |
| | 3 | 140 | 5.5/2.0 |
| | 4 | 140 | 5.5/2.0 |
| Comp.Ex. | 1 | 140 | 18.5/3.5 |

The tear tapes T having the layer structure shown in FIG. 12 were heat-sealed on each of the five cover films, thus producing four tearable sealing members G according to the embodiment of the present invention, and one sealing member for the Comparison Example 1.

The tear tape T comprised a base member B of biaxial oriented polyester film having a thickness of 38 μm, an ethylene-vinyl acetate sealant layer D having a thickness of 30 μm and a drawn nylon layer as a cushion layer having a thickness of 15 μm.

The heat sealing conditions are 115° C., 2.8 kg/cm$^2$ and 3 sec.

A curling amount of the tearable sealing member G thus manufactured was measured as a curling amount 1 in the non-oriented direction as shown in FIG. 9.

The results are shown in Table 2.

TABLE 2

| Sample Nos. | | Curling amount 1 (non-oriented direction) | Curling amount 1' (oriented direction) |
|---|---|---|---|
| Emb.Ex. | 1 | 4.90 | 3.50 |
| | 2 | 5.78 | 4.46 |
| | 3 | 5.55 | 4.20 |
| | 4 | 5.56 | 4.23 |
| Comp.Ex. | 1 | 10.44 | 12.73 |

The size of the cover film K was 27.00×210 mm, and the tear tape T size was 16.5×550 mm.

As will be understood from Table 2, in the Comparison Example 1 in which the heater contraction rate is 3.5% in the non-oriented direction exhibited significantly large curling amount 1 in the non-oriented direction, as compared with the Embodiment Examples 1–4.

Table 2 also shows the curling amount 1' in the oriented direction. As will be apparent from Table 2, the Comparison Example 1 in which the heat contraction rate in the oriented direction is 18.5% exhibited significantly large curling amount 1', as compared with the Embodiment Examples 1–4.

The 5 samples were heat-sealed to a developer container having an opening of 18.5×200 mm. The correct heat sealing was easily carried out with the tearable sealing members G according to Embodiment Examples 1–4, but with the sealing member of the Comparison Example, the correct heat sealing was not easily possible. So that the correct sealing was possible only when the curl confining process with particular jig addicted for the curl confinement were required with the result of manufacturing cost increase.

It has been confirmed that the heat sealing operation is easily carried out without problem if the heat contraction ratio is not less than 1% and not more than 10% in the oriented direction and not less than 0.1% and not more than 3% in the non-oriented direction.

Experiment 2

Similarly to Experiment 1, three base members A having a thickness of 120 μm and 140 μm as the cover film K. The same ethylene vinyl acetate sealant layer C having a thickness of 20 μm was dry laminated, for each. As a Comparison Example, the cover film base member having the rupture strength in the non-oriented direction outside the range described above, was prepared.

The specifications were as follows.

TABLE 3

| Sample Nos. | Film thickness (μm) | Rupture (non-oriented direction) (kg/mm) |
|---|---|---|
| Emb.Ex. 5 | 140 | 1.4 |
| 6 | 140 | 1.4 |
| 7 | 140 | 1.4 |
| Comp.Ex. 2 | 120 | 0.6 |

The four cover films and tear tapes T having the layer structure of FIG. 12 are heat sealed together to produce tearable sealing members G using the embodiments and one sealing member of a Comparison Example 2.

The tear tape T comprises a base member B in the form of a biaxial oriented polyester film having a thickness of 38 μm, an ethylene vinyl acetate sealant layer D having a thickness of 30 μm, and a drawn nylon layer N as a friction layer having a thickness of 15 μm, as in Experiment 1.

The heat sealing conditions were 115° C., 2.8 kg/cm$^2$ and 3 sec.

The sizes of the cover film K and the tear tape T were the same as Experiment 1.

The four tearable sealing members are heat-sealed on a developer container Y having an opening width of 50 cm, and then, the pressure durabilities were determined.

The container Y was made of polystyrene material, and the heat sealing conditions for the developer container Y were 140° C., 5.0 kg/cm$^2$ and 5.5 sec.

The heat sealing operations were carried out after confirmation of the correct parallelism between the heat seal bar 2 and the sealing surface of the container Y.

In the pressure durability test, the pressure is increased with increment of 0.05 kgf/cm$^2$ and with pressure maintaining of 5 sec, until the cover film is torn in the non-oriented direction at the edge (puncture.

The results are shown in Table 4.

TABLE 4

| Sample Nos. | Pressure durability (kgf) | Falling test |
|---|---|---|
| Emb.Ex. 5 | 491 | No leak |
| 6 | 475 | No leak |
| 7 | 475 | No leak |
| Comp.Ex. 2 | 357 | Leaked |

As will be understood from Table 4, the pressure durability according to the embodiment is approx. 1.4 times the Comparison Example.

After the heat sealing of the four tearable sealing members on the developer containers, the same amount of developer was filled into each, and each is bonded with drum container through ultrasonic wave bonding, by which four kinds of process cartridges Z were produced.

The cartridges Z are packaged in the same manner, and they are let fall at a height of 150 cm, and the developer leakage was checked.

In the falling tests, one corner, 3 edge and 6 surface fallings were carried out.

As will be understood from Table 4, no problems are observed in Embodiment Examples 5–7, but with the Comparison Example 2, the cover film K is torn at the edge with the results of developer leakage.

As will be understood from the foregoing, the tearable sealing member according to this embodiment in which the rapture strength of the cover film base member A is not less than 1.5 kg/mm, and not more than 3 kg/mm in the non-oriented direction exhibits so strong pressure durability to avoid developer leakage even upon falling impact during transportation of the process cartridge.

Particularly, in the case of a wide opening developer container, the sealing is particularly effective.

Experiment 3

Three base members A having thicknesses of 120 μm and 140 μm were prepared as the cover film K as in Experiment 1. The same ethylene vinyl acetate sealant layer C having a thickness of 20 μm is dry-laminated to produce two kinds of cover films K.

As Comparison Examples, two cover film base members having average densities outside the range described above, were manufactured.

The specifications of the base members were as follows:

TABLE 5

| Sample Nos. | Film thickness (μm) | Ave. density (g/cc) |
|---|---|---|
| Emb.Ex. 8 | 120 | 0.61 |
| Emb.Ex. 9 | 140 | 0.68 |
| Comp.Ex. 3 | 140 | 0.59 |
| Comp.Ex. 4 | 120 | 0.57 |

The four cover films and the tear tapes T having the layer structure of FIG. 12 are heat-sealed, thus producing sealing members G according to the embodiment of the invention and sealing members of Comparison Examples 3 and 4.

The tear tape T, similarly to Experiment 1, comprised a base member B of biaxial oriented polyester film having a thickness of 38 μm, an ethylene vinyl acetate sealant layer D having a thickness of 30 μm, and a drawn nylon layer N as a cushion layer having a thickness of 15 μm. The heat sealing conditions were 115° C., 2.8 kg/cm$^2$ and 3 sec.

The cover films K and the tear tapes T have the same sizes as in Experiment 1.

The four kinds of tearable sealing members are heat-sealed on the developer containers, and thereafter, the sealing members are removed by pulling it. Thereafter, the measurements were carried out for the bonding strength (180 degrees peeling), tearing width expansion between the leading edge and the trailing edge, and the tearing stability (fuzz occurrence).

The heat sealing conditions were the same as in Embodiments 5–7.

The results are shown in Table 6.

TABLE 6

| Sample Nos. | Bonding strength (kgf) | Tear expansion (mm) | Tear stability (cohesive peeling, fuzz) |
|---|---|---|---|
| Emb.Ex. 8 | 2.04 | 0.90 | No problem |
| Emb.Ex. 9 | 2.10 | 0.90 | No problem |
| Comp.Ex. 3 | 2.14 | 0.87 | fuzz |
| Comp.Ex. 4 | 2.21 | 0.93 | fuzz |

As show in Table 6, as regards the bonding strength (180 degrees peeling) and the width expansion are the same in the four sealing members. However, as regards the tearing stability, the fuzz occurs in the Comparison Examples, whereas no fuzz occurs in the Embodiments of the present invention.

Accordingly, the tearing stability can be assured when the average density of the cover film base member A is not less than 0.6 g/cc and not more than 0.9 g/cc.

As described in the foregoing, according to the present invention, a tearable sealing member having balanced film curling property, tearing property and the film strength, and the developer container and the process cartridge using the same. The present invention is particularly preferable when the opening width of the developer container is not less than 30 cm, further preferably not less than 50 cm.

By the average density of the cover film base member not less than 0.6 g/cc, the cover film base member is in the form of a complete film, so that the occurrence of fuzz at the torn part, can be avoided, thus assuring the longitudinal tearing.

By the rupture strength of the cover film base member not less than 1 kg/mm, it is not easily torn in the non-oriented direction, so that it can be avoided that the cover film is torn in the longitudinal direction, that is, in the non-oriented direction by the falling and impact imparted to the developer container with the result of the developer leakage.

The heat contraction of the cover film base member is limited in a predetermined range, the curling upon the heat fusing between the cover film and the tear tape can be avoided, so that the sealing member constituted by the cover film and the tear tape can be correctly heat fused.

By properly controlling the above-described average density, the rupture strength in the non-oriented direction and the heat contraction rate, the longitudinal tearing stability, the pressure durability and the curling property can be improved.

While the invention has been described with reference to the structures disclosed herein, it is not confined to the details set forth and this application is intended to cover such modifications or changes as may come within the purposes of the improvements or the scope of the following claims.

What is claimed is:

1. A cartridge having a developing device and detachably mountable to an electrophotographic image forming apparatus, said cartridge comprising:

a developer container for containing developer and having a supply opening through which the developer may be supplied;

a sealing film, including a base material of a uniaxially oriented foamed resin material having an average density of not less than 0.65 g/cc and not more than 0.8 g/cc measured under JIS K6758, and a heat contraction rate in the oriented direction of not less than 1.0% and not more than 10%, measured when it is heated in a hot air oven at 120 degrees celsius for fifteen minutes, for sealing said supply opening;

a flexible tape for tearing said sealing film, said flexible tape being lined on said sealing film along a longitudinal direction of said supply opening, and one end of said flexible tape being extended out of said cartridge through an end opening; and an elastic sealing member for preventing leakage of the developer from said developer container, said elastic sealing member being provided along an edge of said supply opening, and being compressed and contacted to a surface that is substantially the same as a surface in which said supply opening is provided, said sealing film being slidable relative to said elastic sealing member.

2. A cartridge according to claim 1, wherein said base material is of foamed polypropylene resin.

3. A cartridge according to claim 1, wherein a rupture strength of said base material in a non-oriented direction is not less than 1.6 kg/mm and not more than 3 kg/mm.

4. A cartridge according to claim 1, wherein a heat contraction rate of said base material is not less than 1% and not more than 10.0% in an oriented direction, and not less than 0.1% and not more than 3% in a non-oriented direction.

5. A cartridge according to claim 1, wherein said elastic sealing member has been compressed to one half or to one third of an original thickness.

6. A cartridge according to claim 1, wherein said flexible tape has a tensile strength that is not less than 3 times that of said sealing film.

7. A cartridge according to claim 1, wherein said flexible tape is bonded on a back side of said sealing film.

8. A cartridge according to claim 7, wherein said sealing film and said flexible tape are welded to each other.

9. A cartridge according to claim 1, wherein said base material has a film thickness of not less than 130 microns and not more than 150 microns.

10. A cartridge according to claim 1, wherein said supply opening has a width of not less than 50 mm.

11. A cartridge according to claim 1, further comprising an image bearing member for bearing an electrostatic image to be developed by said developing device.

12. A tearable sealing member for unsealably sealing a supply opening of a developer container for containing a developer for an electrophotographic image forming apparatus, comprising:

a seal film including a uniaxially oriented film for closing the supply opening; and a flexible tape extending along a surface of said seal film;

wherein said uniaxially oriented film has an average density of not less than 0.65 g/cc and not more than 0.8 g/cc measured under JIS K6758, and a heat contraction rate in the oriented direction of not less than 1.0% and not more than 10%, measured when it is heated in a hot air oven at 120 degrees celsius for fifteen minutes;

wherein the seal film is torn and the opening is opened by pulling the flexible tape.

13. A sealing member according to claim 12, wherein said uniaxially oriented film is a uniaxially oriented synthetic resin film.

14. A sealing member according to claim 12, wherein said uniaxially oriented film is a uniaxially foamed polypropylene resin film.

15. A sealing member according to claims 12, 13, or 14, wherein said flexible tape has a tensile strength which is not less than three times that of said seal film.

16. A sealing member according to claim 12, wherein said flexible tape comprises a first portion extending along the surface of said seal film and a second portion which extends from the first portion after being folded back and which is disposed at the other surface of said seal film.

17. A sealing member according to claim 16, wherein said first portion of said flexible tape is adhered to said seal film.

18. A sealing member according to claim 17, wherein said first portion of said flexible tape and said seal film are bonded with each other by heat fusing between a sealant layer of said flexible tape and a sealant layer of said seal film.

19. A sealing member according to claim 18, wherein said flexible tape includes a biaxially oriented polyester film.

20. A sealing member according to claim 19, wherein said sealant layer is a polyethylene sealant.

21. A developing apparatus for an electrophotographic image forming apparatus, comprising:

a developer container for containing a developer, said container having a supply opening for supplying the developer therefrom;

a tearable sealing member for unsealably sealing the opening, said tearable member including:

a seal film including a uniaxially oriented film for closing the supply opening; and a flexible tape extending along a surface of said seal film;

wherein said uniaxially oriented film has an average density of not less than 0.65 g/cc and not more than 0.8 g/cc measured under JIS K6758, and a heat contraction rate in the oriented direction of not less than 1.0% and not more than 10%, measured when it is heated in a hot air oven at 120 degrees celsius for fifteen minutes;

wherein the seal film is torn and the opening is opened by pulling the flexible tape.

22. An apparatus according to claim 21, wherein said uniaxially oriented film is a uniaxially oriented synthetic resin film.

23. An apparatus according to claim 22, wherein said uniaxially oriented film is a uniaxially foamed polypropylene resin film.

24. An apparatus according to claims 21, 22, or 23, wherein said flexible tape has a tensile strength which is not less than three times that of said seal film.

25. An apparatus according to claim 21, wherein said flexible tape comprises a first portion extending along the surface of said seal film and a second portion which extends from the first portion after being folded back and which is disposed at the other surface of said seal film.

26. An apparatus according to claim 25, wherein said first portion of said flexible tape is adhered to said seal film.

27. An apparatus according to claim 26, wherein said first portion of said flexible tape and said seal film are bonded with each other by heat fusing between a sealant layer of said flexible tape and a sealant layer of said seal film.

28. An apparatus according to claim 27, wherein said flexible tape includes a biaxially oriented polyester film.

29. An apparatus according to claim 28, wherein said sealant layer is a polyethylene sealant.

30. A process cartridge detachable mountable to an electrophotographic image forming apparatus, comprising:

an image bearing member;

a developing apparatus comprising:

a developer container for containing a developer, said container having a supply opening for supplying the developer therefrom; and a tearable sealing member for unsealably sealing the opening, said tearable member including:

a seal film including a uniaxially oriented film for closing the supply opening; and a flexible tape extending along a surface of said seal film for sealing the opening;

wherein said uniaxially oriented film has an average density of not less than 0.65 g/cc and not more than 0.8 g/cc measured under JIS K6758, and a heat contraction rate in the oriented direction of not less than 1.0% and not more than 10%, measured when it is heated in a hot air oven at 120 degrees celsius for fifteen minutes;

wherein the seal film is torn and the opening is opened by pulling the flexible tape.

31. A process cartridge according to claim 30, wherein said process cartridge further comprises a charging roller.

32. A process cartridge according to claim 30, wherein said developer container is provided with a supply port for supplying the developer into said container and stirring means for stirring the developer therein.

33. A process cartridge according to claim 30, wherein said uniaxially oriented film is a uniaxially oriented synthetic resin film.

34. A process cartridge according to claim 31, wherein said uniaxially oriented film is a uniaxially foamed polypropylene resin film.

35. A process cartridge according to claims 30, 31, or 32, wherein said flexible tape has a tensile strength which is not less than three times that of said seal film.

36. A process cartridge according to claim 30, wherein said flexible tape comprises a first portion extending along the surface of said seal film and a second portion which extends from the first portion after being folded back and which is disposed at the other surface of said seal film.

37. A process cartridge according to claim 36, wherein said first portion of said flexible tape is adhered to said seal film.

38. A process cartridge according to claim 36, wherein said first portion of said flexible tape and said seal film are bonded with each other by heat fusing between a sealant layer of said flexible tape and a sealant layer of said seal film.

39. A process cartridge according to claim 36, wherein said flexible tape includes a biaxially oriented polyester film.

40. A process cartridge according to claim 38, wherein said sealent layer is a polyethylene sealant.

41. An electrophoto graphic image forming apparatus for forming an image on a recording material, comprising:

(a) mounting means for detachably mounting a process cartridge to a main assembly of said image forming apparatus, wherein said process cartridge includes:

an electrophotographic image bearing member;

a developing apparatus including:

a developer container for containing a developer, said container having a supply opening for supplying the developer therefrom; and a tearable sealing member for unsealably sealing the opening, said tearable sealing member including:

a seal film including a uniaxially oriented film for closing the supply opening; and a flexible tape extending along a surface of said seal film for sealing the opening;

wherein said uniaxially oriented film has an average density of not less than 0.65 g/cc and not more than 0.8 g/cc, measured under JIS K6758, and a heat contraction rate in the oriented direction of not less than 1.0% and not more than 10.0%, measured when it is heated in a hot air oven at 120° C. for 15 minutes;

wherein the seal film is torn and the opening is opened by pulling the flexible tape; and (b) feeding means for feeding the recording material.

* * * * *

UNITED STATES PATENT AND TRADEMARK OFFICE

CERTIFICATE OF CORRECTION

PATENT NO. : 5,909,606

DATED : June 1, 1999

INVENTOR(S) : YASUO FUJIWARA

It is certified that error appears in the above-identified patent and that said Letters Patent is hereby corrected as shown below:

ON THE COVER PAGE, AT [57] ABSTRACT

Line 8, after "seal" insert --film--.

COLUMN 1

Line 31, "with at" should read --at--.

COLUMN 2

Line 33, "the" should read --wherein the--.
Line 64, "corrected" should read --correctly--.

COLUMN 3

Line 22, "a" should read --an--.

UNITED STATES PATENT AND TRADEMARK OFFICE

CERTIFICATE OF CORRECTION

PATENT NO. : 5,909,606

DATED : June 1, 1999

INVENTOR(S) : YASUO FUJIWARA

It is certified that error appears in the above-identified patent and that said Letters Patent is hereby corrected as shown below:

COLUMN 4

Line 2, "thermo compression" should read --thermo-compression--.
Line 35, "a" should read --an--.

COLUMN 5

Line 50, "(thermocompression" should read --(thermo-compression--.
Line 55, "the made is used with" should read --use is made of--.

COLUMN 6

Line 14, "thermocompression" should read --thermo-compression--.
Line 44, "layer" should read --laser--.

UNITED STATES PATENT AND TRADEMARK OFFICE

CERTIFICATE OF CORRECTION

PATENT NO. : 5,909,606

DATED : June 1, 1999

INVENTOR(S) : YASUO FUJIWARA

It is certified that error appears in the above-identified patent and that said Letters Patent is hereby corrected as shown below:

COLUMN 9

Line 3, before "as" insert --were prepared--.
Line 43, "2" should read --102--.
Line 47, "(puncture" should read --(puncture)--.

COLUMN 10

Line 12, "rapture" should read --rupture--.
Line 14, "so" should read --sufficiently--.

UNITED STATES PATENT AND TRADEMARK OFFICE

CERTIFICATE OF CORRECTION

PATENT NO. : 5,909,606

DATED : June 1, 1999

INVENTOR(S) : YASUO FUJIWARA

It is certified that error appears in the above-identified patent and that said Letters Patent is hereby corrected as shown below:

COLUMN 11

Line 11, "show" should read --shown--.
Line 24, after "same" insert --is provided--.

COLUMN 13

Line 55, "detachable" should read --detachably--.

COLUMN 14

Line 39, "electrophoto graphic" should read --electrophotographic--.

Signed and Sealed this

Eleventh Day of April, 2000

*Attest:*

*Attesting Officer*

Q. TODD DICKINSON

*Director of Patents and Trademarks*